US010322496B2

(12) United States Patent
Lin

(10) Patent No.: US 10,322,496 B2
(45) Date of Patent: Jun. 18, 2019

(54) OPEN-END WRENCH

(71) Applicant: Chen Chih Lin, New Taipei (TW)

(72) Inventor: Chen Chih Lin, New Taipei (TW)

( * ) Notice: Subject to any disclaimer, the term of this patent is extended or adjusted under 35 U.S.C. 154(b) by 161 days.

(21) Appl. No.: 15/642,698

(22) Filed: Jul. 6, 2017

(65) Prior Publication Data

US 2017/0297175 A1 Oct. 19, 2017

(51) Int. Cl.

| | |
|---|---|
| ***B25B 13/16*** | (2006.01) |
| ***B25B 13/08*** | (2006.01) |
| ***B25B 13/12*** | (2006.01) |
| ***B25B 23/00*** | (2006.01) |

(52) U.S. Cl.

CPC ..... *B25B 13/16* (2013.01); *B25B 13/08* (2013.01); *B25B 13/12* (2013.01); *B25B 23/0028* (2013.01)

(58) Field of Classification Search

CPC ..... B25B 13/16; B25B 13/12; B25B 23/0028
See application file for complete search history.

(56) References Cited

U.S. PATENT DOCUMENTS

| | | | | | |
|---|---|---|---|---|---|
| 166,814 | A * | 8/1875 | Samuel | B25B 13/12 | 81/126 |
| 1,419,404 | A * | 6/1922 | Olson | B25B 13/16 | 81/165 |
| 1,792,338 | A * | 2/1931 | Walz | B25B 13/12 | 81/145 |
| 1,870,326 | A * | 8/1932 | Emmett | B25B 13/12 | 81/133 |
| 2,719,448 | A * | 10/1955 | Bugge | B25B 13/12 | 81/145 |
| 4,437,364 | A * | 3/1984 | Martinmaas | B25B 13/46 | 81/179 |
| 2005/0016335 | A1* | 1/2005 | Tuan Mu | B25B 13/12 | 81/179 |
| 2014/0060262 | A1* | 3/2014 | Hsu | B25B 13/12 | 81/129 |

FOREIGN PATENT DOCUMENTS

| | | | | |
|---|---|---|---|---|
| FR | 2945466 | A1 * | 11/2010 | B25B 13/16 |

* cited by examiner

*Primary Examiner* — Daniel J Colilla

(57) ABSTRACT

An open-end wrench includes a stationary jaw including an inclined hole, a through hole adjacent to a first end of an interior surface and communicating with the inclined hole, and a forward hook; a handle pivotably secured to a rear end of the stationary jaw; and a moveable jaw including a forward hook; a hollow cylinder extending from a rear portion to dispose in the inclined hole, the hollow cylinder having an elongated slot on a surface and communicating with an interior of the hollow cylinder, and internal threads at an open end of the hollow cylinder; a biasing member disposed in the hollow cylinder, a threaded fastener secured to the internal threads to urge against a first end of the biasing member; and a pin inserted through the through hole and the elongated slot to stop at a second end of the biasing member.

1 Claim, 5 Drawing Sheets

OPEN-END WRENCH

BACKGROUND OF THE INVENTION

1. Field of the Invention

The invention relates to wrenches and more particularly to an open-end wrench having a spring biased moveable jaw.

2. Description of Related Art

A conventional adjustable wrench comprises sockets arranged at two ends of a wrench body respectively; an adjustment screw bolt arranged on the wrench body; an adjustable wrench support matching with sockets separately arranged on two ends of the adjustment screw bolt; an adjustment threaded sleeve arranged between the adjustment wrench support and the adjustment screw bolt, wherein the adjustment threaded sleeve is screwed with a threaded wall of an inner wall of the wrench body; and an adjustable button fixed with the adjustment screw bolt arranged on the wrench body, wherein the adjustable button is between the sockets, wherein the adjustable wrench support is adapted to be adjustable with the adjustable button and the diameters of the sockets at two ends of the wrench body vary from each other.

While the adjustable wrench enjoys its success in the market, continuing improvements in the exploitation of wrench are constantly being sought.

SUMMARY OF THE INVENTION

It is therefore one object of the invention to provide an open-end wrench comprising a stationary jaw including first, second, and third sections on an interior surface, two angles on the interior surface, an inclined hole, a through hole adjacent to a first end of an interior surface and communicating with the inclined hole, and a hook at a forward end; a handle pivotably secured to a rear end of the stationary jaw; and a moveable jaw including first, second, and third sections on an interior surface; two angles on the interior surface; a hook at a forward end; a hollow cylinder extending from a rear portion to dispose in the inclined hole, the hollow cylinder having an elongated slot on a surface and communicating with an interior of the hollow cylinder, and internal threads at an open end of the hollow cylinder; a biasing member disposed in the hollow cylinder, a threaded fastener secured to the internal threads to urge against a first end of the biasing member; and a pin inserted through the through hole and the elongated slot to stop at a second end of the biasing member, the pin being configured to move in the elongated slot.

The above and other objects, features and advantages of the invention will become apparent from the following detailed description taken with the accompanying drawings.

DETAILED DESCRIPTION OF THE INVENTION

Figure 1:
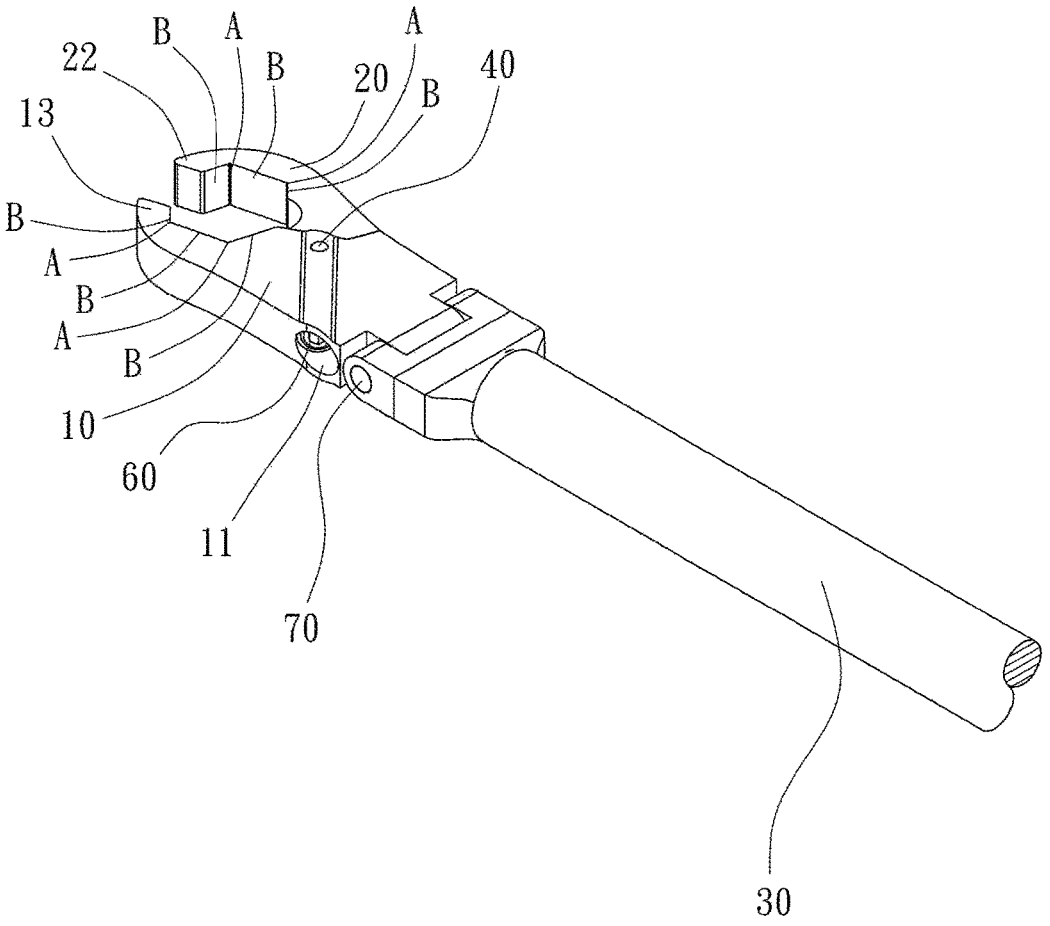
FIG. 1 is a perspective view of an open-end wrench according to the invention.
Figure 2:
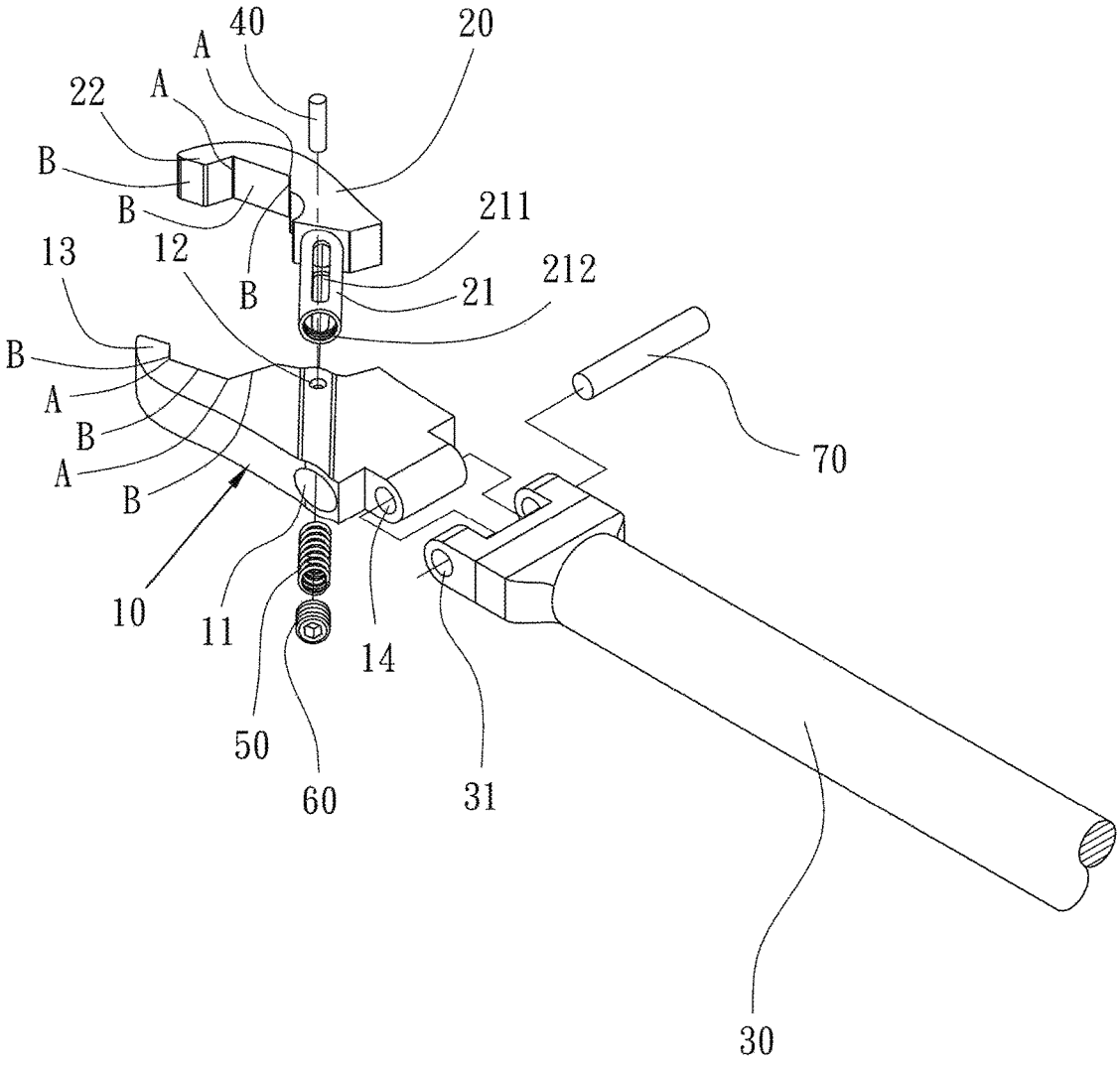
FIG. 2 is an exploded view of FIG. 1.
Figure 3:
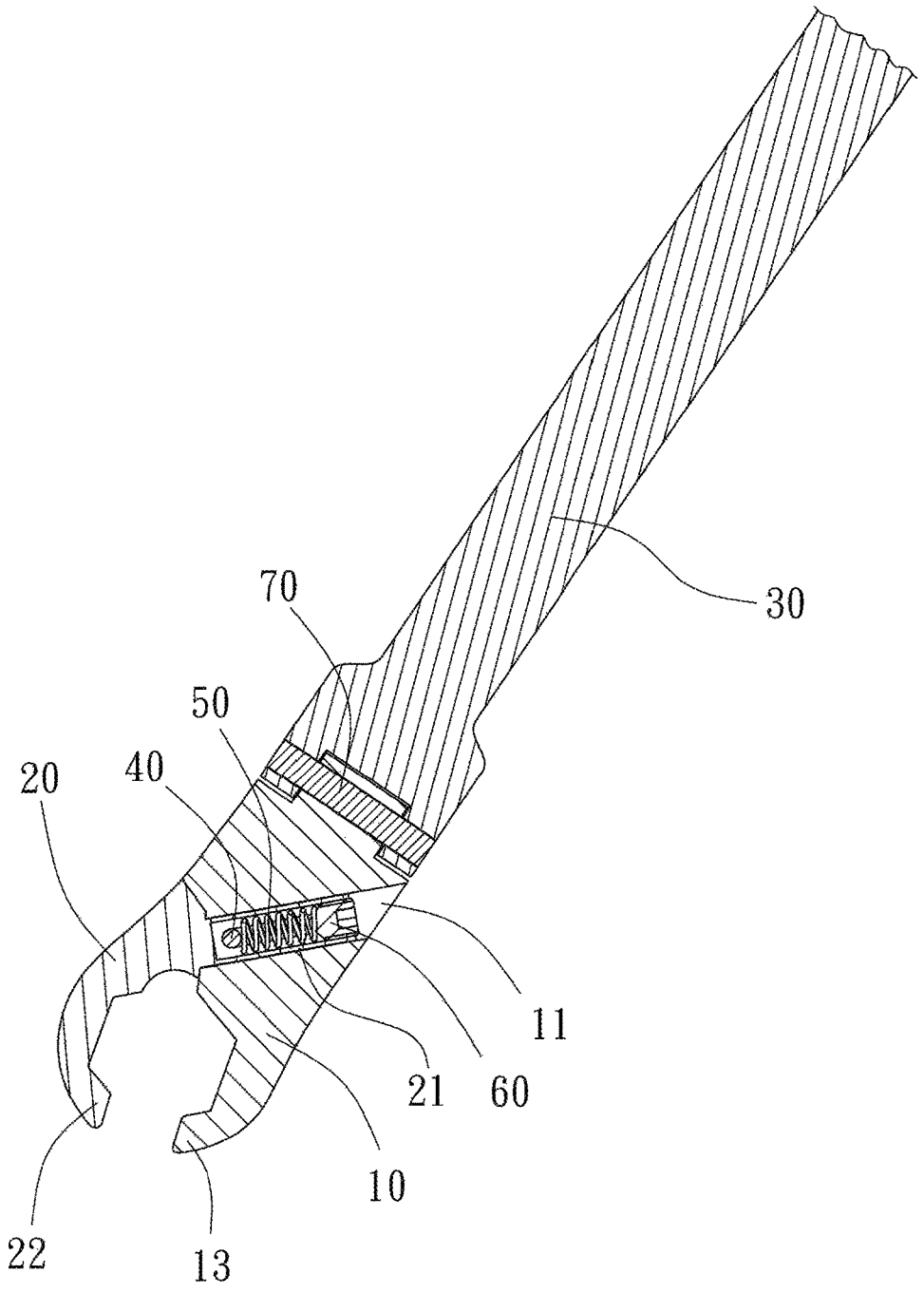
FIG. 3 is a longitudinal sectional view of FIG. 1.
Figure 4:
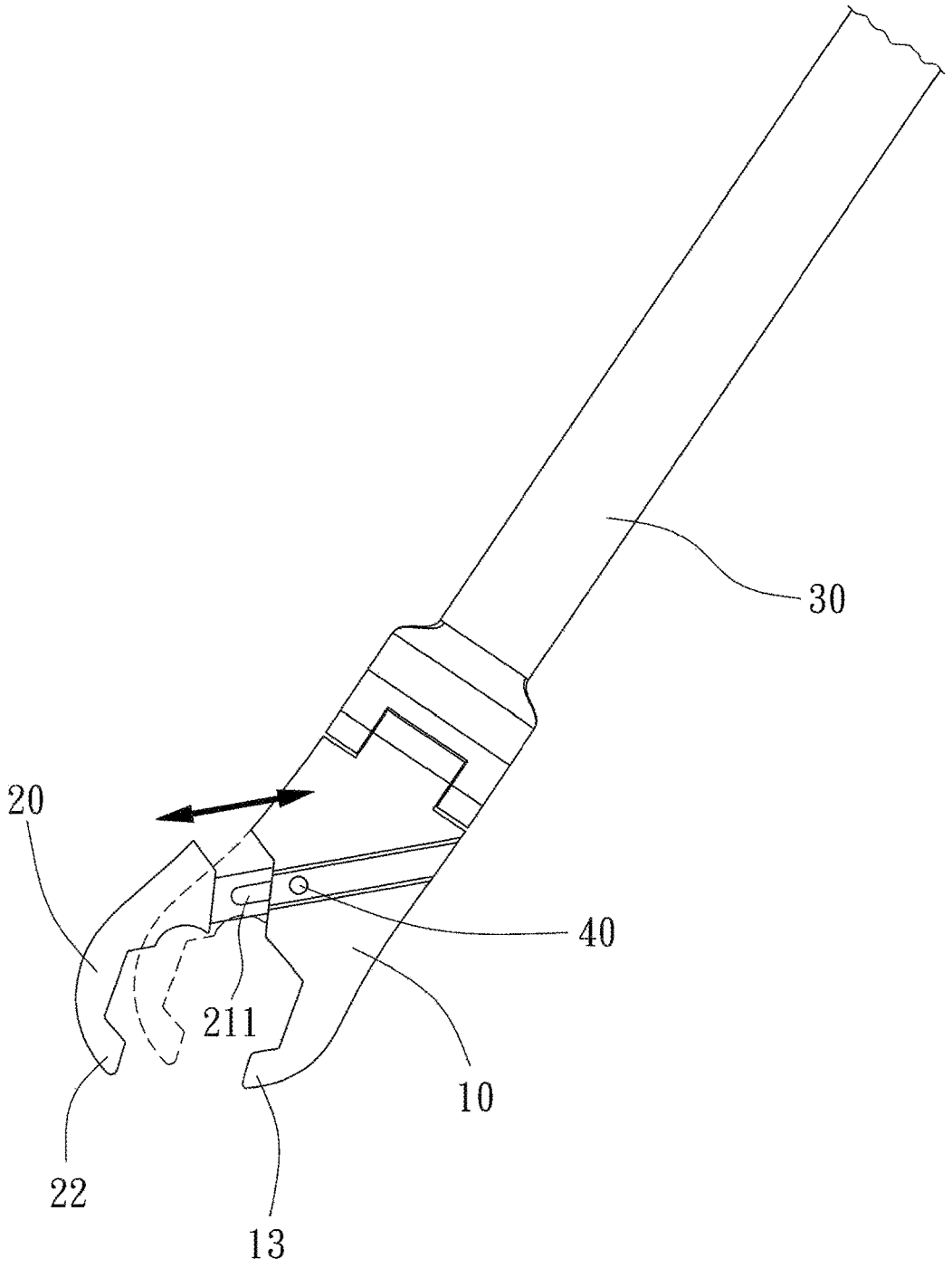
FIG. 4 is a side elevation of FIG. 1 showing a movement of the moveable jaw relative to the stationary jaw.
Figure 5:
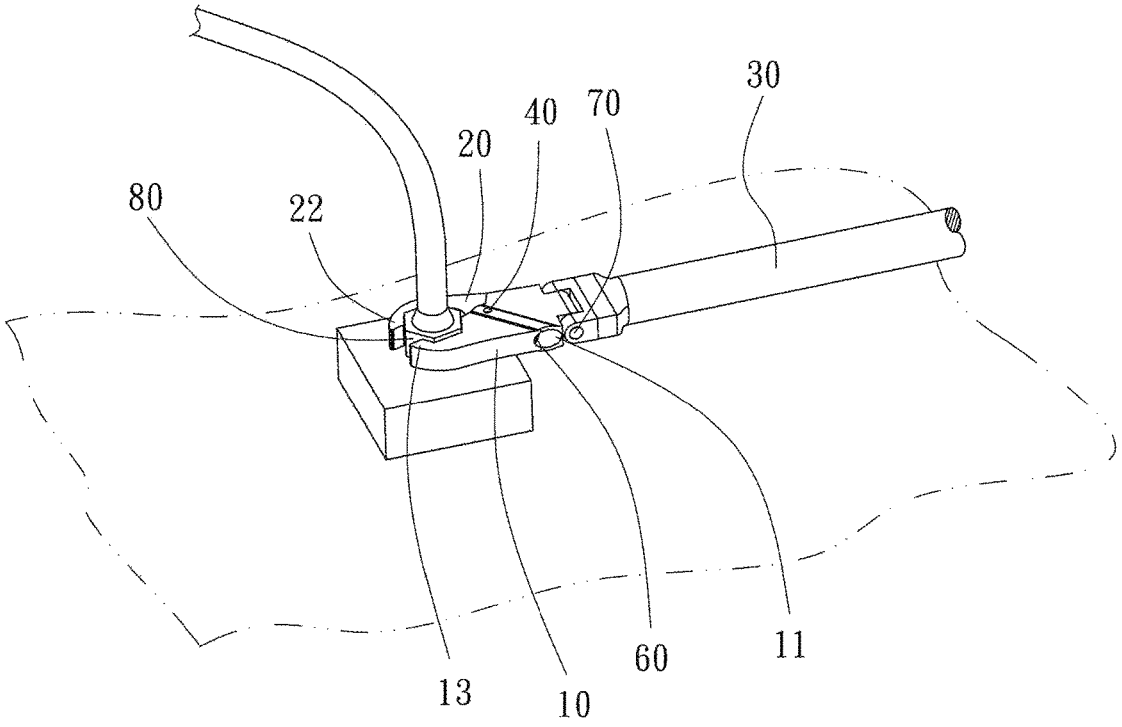
FIG. 5 is an environmental view of the open-end wrench working on a nut.

Referring to FIGS. 1 to 5, an open-end wrench in accordance with the invention comprises the following components as discussed in detail below.

A stationary jaw 10 includes an inclined hole 11, a through hole 12 communicating with the inclined hole 11 adjacent to one end of an interior surface, a hook 13 at a forward end 13, and a channel 14 at a rear end.

A handle 30 includes a through hole 31 at a front end. A pin 70 is driven through the through hole 31 and the channel 14 to pivotably fasten the handle 30 and the stationary jaw 10 together.

A moveable jaw 20 includes a hook 22 at a forward end and a hollow cylinder 21 extending from a rear portion and having an elongated slot 211 communicating with the hollow cylinder 21, and internal threads 212 at an open end of the hollow cylinder 21. The hollow cylinder 21 is releasably disposed in the inclined hole 11. A torsion spring 50 is disposed in the hollow cylinder 21. A bolt 60 is secured to the internal threads 212 to urge against the other end of the torsion spring 50. A pin 40 is inserted through the through hole 12 and the elongated slot 211 to engage one end of the torsion spring 50. Thus, in use the mouth of the open-end wrench can be widely opened by pulling the moveable jaw 20 away from the stationary jaw 10 with the hollow cylinder 21 partially exposed, the torsion spring 50 compressed, and the pin 40 moved from one position of the elongated slot 211 to another position of the elongated slot 211 (see FIG. 4).

The stationary jaw 10 has first, second, and third sections B of an interior surface; and two angles A on the interior surface. Likewise and corresponding to the stationary jaw 10, the moveable jaw 20 has first, second, and third sections B of an interior surface; and two angles A on the interior surface.

While the invention has been described in terms of preferred embodiments, those skilled in the art will recognize that the invention can be practiced with modifications within the spirit and scope of the appended claims.

What is claimed is:

1. An open-end wrench comprising:

a stationary jaw including first, second, and third sections on an interior surface, two angles on the interior surface, an inclined hole, a through hole adjacent to a first end of an interior surface and communicating with the inclined hole, and a hook at a forward end;

a handle pivotably secured to a rear end of the stationary jaw; and a moveable jaw including first, second, and third sections on an interior surface; two angles on the interior surface; a hook at a forward end; a hollow cylinder extending from a rear portion to dispose in the inclined hole, the hollow cylinder having an elongated slot on a surface and communicating with an interior of the hollow cylinder, and internal threads at an open end of the hollow cylinder; a biasing member disposed in the hollow cylinder, a threaded fastener secured to the internal threads to urge against a first end of the biasing member; and a pin inserted through the through hole and the elongated slot to stop at a second end of the biasing member, the pin being configured to move in the elongated slot.

* * * * *